US008057182B2

(12) United States Patent
Brittingham et al.

(10) Patent No.: US 8,057,182 B2
(45) Date of Patent: Nov. 15, 2011

(54) METERED COOLING SLOTS FOR TURBINE BLADES

(75) Inventors: Robert A. Brittingham, Piedmont, SC (US); Robert J. Reed, Simpsonville, SC (US); Kevin L. Bruce, Greer, SC (US); David R. Johns, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 489 days.

(21) Appl. No.: 12/275,922

(22) Filed: Nov. 21, 2008

(65) Prior Publication Data

US 2010/0129231 A1 May 27, 2010

(51) Int. Cl.
*F01D 5/18* (2006.01)

(52) U.S. Cl. ..... 416/97 R; 415/115; 416/95; 416/96 R

(58) Field of Classification Search ..... 415/115; 416/95, 96 R, 97 R
See application file for complete search history.

(56) References Cited

U.S. PATENT DOCUMENTS 4,601,638 A 7/1986 Hill et al.
4,650,949 A 3/1987 Field
4,669,957 A 6/1987 Phillips et al.
4,672,727 A 6/1987 Field
4,676,719 A 6/1987 Auxier et al.
4,726,735 A 2/1988 Field et al.
5,382,133 A 1/1995 Moore et al.
5,702,232 A 12/1997 Moore
6,050,777 A 4/2000 Tabbita et al.
6,164,912 A 12/2000 Tabbita et al.
6,210,112 B1 4/2001 Tabbita et al.
6,234,755 B1 5/2001 Bunker et al.
6,347,660 B1 2/2002 Sikkenga et al.
6,955,522 B2 10/2005 Cunha et al.
6,994,521 B2 2/2006 Liang
7,186,085 B2 * 3/2007 Lee ..... 416/97 R
2006/0002788 A1 1/2006 Liang

* cited by examiner

*Primary Examiner* — Asok Sarkar
(74) *Attorney, Agent, or Firm* — Mark E. Henderson; Ernest G. Cusick; Frank A. Landgraff

(57) ABSTRACT

A metered cooling slot disposed in a wall comprising an outer surface that is exposed to a hot gas stream and an inner surface that defines an internal coolant chamber through which a coolant passes, the metered cooling slot comprising: a slot formed within the outer surface elongated in a first direction, the slot comprising a pair of spaced apart, opposing, slot surfaces and a base, the slot surfaces intersecting the outer surface to form a slot outlet opposite the base; and two or more metering apertures formed within the wall, each metering aperture intersecting the inner surface of the wall to form a metering aperture inlet and intersecting one of the pair of slot surfaces to form a metering aperture outlet; wherein: D represents the approximate diameter of at least two of the metering apertures; P represents the approximate distance between the center lines of at least two neighboring metering apertures; and P/D comprises a value within the range of about 4 to 6.

20 Claims, 6 Drawing Sheets

METERED COOLING SLOTS FOR TURBINE BLADES

BACKGROUND OF THE INVENTION

This present application relates generally to apparatus, methods and/or systems for improving film cooling of components in gas turbine engines. More specifically, but not by way of limitation, the present application relates to apparatus, methods and/or systems pertaining to film cooling slots with metered flow.

Gas turbine engines typically include a compressor, a combustor, and a turbine. The compressor and turbine generally include rows of blades that are axially stacked in stages. Each stage includes a row of circumferentially-spaced stator blades, which are fixed, and a row of rotor blades, which rotate about a central axis or shaft. In operation, generally, the compressor rotor blades rotate about the shaft, and, acting in concert with the stator blades, compress a flow of air. The supply of compressed air then is used in the combustor to combust a supply of fuel. The resulting flow of hot expanding gases from the combustion is expanded through the turbine section of the engine. The flow of working fluid through the turbine induces the rotor blades to rotate. The rotor blades are connected to a central shaft such that the rotation of the rotor blades rotates the shaft.

In this manner, the energy contained in the fuel is converted into the mechanical energy of the rotating shaft, which, for example, may be used to rotate the rotor blades of the compressor, such that the supply of compressed air needed for combustion is produced, and the coils of a generator, such that electrical power is generated. During operation, because of the high temperatures of the hot-gas path, the velocity of the working fluid, and the rotational velocities found in the compressor and turbine, turbine blades, which, as described, generally include rotor and stator blades, become highly stressed with extreme mechanical and thermal loads.

Often, to reduce the thermal loads, turbine blades are air cooled. Generally, this involves passing a relatively cool supply of compressed air, which is typically bled from the compressor, through internal cooling circuits within the blades. As the compressed air passes through the blade, it convectively cools the airfoil. After passing through the airfoil, the compressed air typically is released through openings on the surface of the blades. When released in a desired manner, the air forms a thin layer or film of relatively cool air at the surface of the airfoil, which both cools and insulates the part from the higher temperatures that surround it. Not surprisingly, this type of cooling is often referred to as "film cooling." Generally, to adequately cool the blades, numerous film cooling openings, which generally are the outlets of hollow passages that originate at interior cooling cavities, are necessary.

For film cooling to be most effective, it necessary that the air exiting the opening remain entrained in a boundary layer on the surface of the blade for an adequate distance downstream of the opening. However, due to a variety of factors, the effectiveness of conventional film cooling systems decreases rapidly as the distance from the cooling opening increases. While this shortcoming may be cured somewhat by increasing the amount of cooling air released, it is well known in the art that the usage of bypass cooling air should be limited due to its negative impact on efficiency. That is, whenever possible, the use of cooling air should be minimized because such cooling air is working fluid which has been extracted from the compressor and its loss from the gas flow path rapidly reduces engine efficiency. Given these competing factors, conventional film cooling methods either prove moderately ineffective or, when effective, come at a significant cost to the engine efficiency. Prior art advancements that include slots with metered flow, such as, for example, U.S. Pat. No. 4,726,735, improved film cooling performance in certain limited ways, but still fell short of employing the cooling air in an efficient and effective manner. As a result, there remains a need for improved film cooling apparatus, methods and/or systems that minimizes the usage of bypass cooling air.

BRIEF DESCRIPTION OF THE INVENTION

The present application thus describes a metered cooling slot disposed in a wall comprising an outer surface that is exposed to a hot gas stream flowing in a downstream direction and an inner surface that defines a portion of an internal coolant chamber through which a coolant passes, the metered cooling slot comprising: a slot formed within the outer surface elongated in a first direction, the slot comprising a pair of spaced apart, opposing, slot surfaces and a base, the slot surfaces intersecting the outer surface at a shallow angle to form a slot outlet opposite the base; and two or more metering apertures formed within the wall, each metering aperture intersecting the inner surface of the wall to form a metering aperture inlet and intersecting one of the pair of slot surfaces to form a metering aperture outlet, the metering aperture being oriented to direct the coolant against the opposite slot surface at a steep angle; wherein: D represents the approximate diameter of at least two of the metering apertures; P represents the approximate distance between the center lines of at least two neighboring metering apertures; and P/D comprises a value within the range of about 4 to 6.

The present application further describes a metered cooling slot disposed in a wall comprising an outer surface that is exposed to a hot gas stream flowing in a downstream direction and an inner surface that defines a portion of an internal coolant chamber through which a coolant passes, the metered cooling slot comprising: a slot formed within the outer surface elongated in a first direction, the slot comprising a pair of spaced apart, opposing, slot surfaces and a base, the slot surfaces intersecting the outer surface at a shallow angle to form a slot outlet opposite the base; and two or more metering apertures formed within the wall, each metering aperture intersecting the inner surface of the wall to form a metering aperture inlet and intersecting one of the pair of slot surfaces to form a metering aperture outlet, the metering aperture being oriented to direct the coolant against the opposite slot surface at a steep angle; wherein: D represents the approximate diameter of at least two of the metering apertures; P represents the approximate distance between the center lines of at least two neighboring metering apertures; L1 comprises the distance from the center line of a metering aperture to the slot outlet; W comprises the width of the slot; $\angle\theta_1$ comprises the angle the slot makes with the outer surface; $\angle\theta_2$ comprises the angle the metering aperture makes with the cooling slot; L2 comprises the distance from the base of the slot to the center line of the metering aperture; P/D comprises a value within the range of about 4.5 to 5.5; L1/D comprises a value of greater than about 8; W/D comprises a value of less than about 0.75; $\angle\theta$1 comprises a value of about 30°; $\angle\theta_2$ comprises a value of about 90°; and L2/D comprises a value within the range of about 0.75 and 1.0.

These and other features of the present application will become apparent upon review of the following detailed description of the preferred embodiments when taken in conjunction with the drawings and the appended claims.

BRIEF DESCRIPTION OF THE DRAWINGS

These and other objects and advantages of this invention will be more completely understood and appreciated by careful study of the following more detailed description of exemplary embodiments of the invention taken in conjunction with the accompanying drawings, in which.

DETAILED DESCRIPTION OF THE INVENTION

Figure 1:
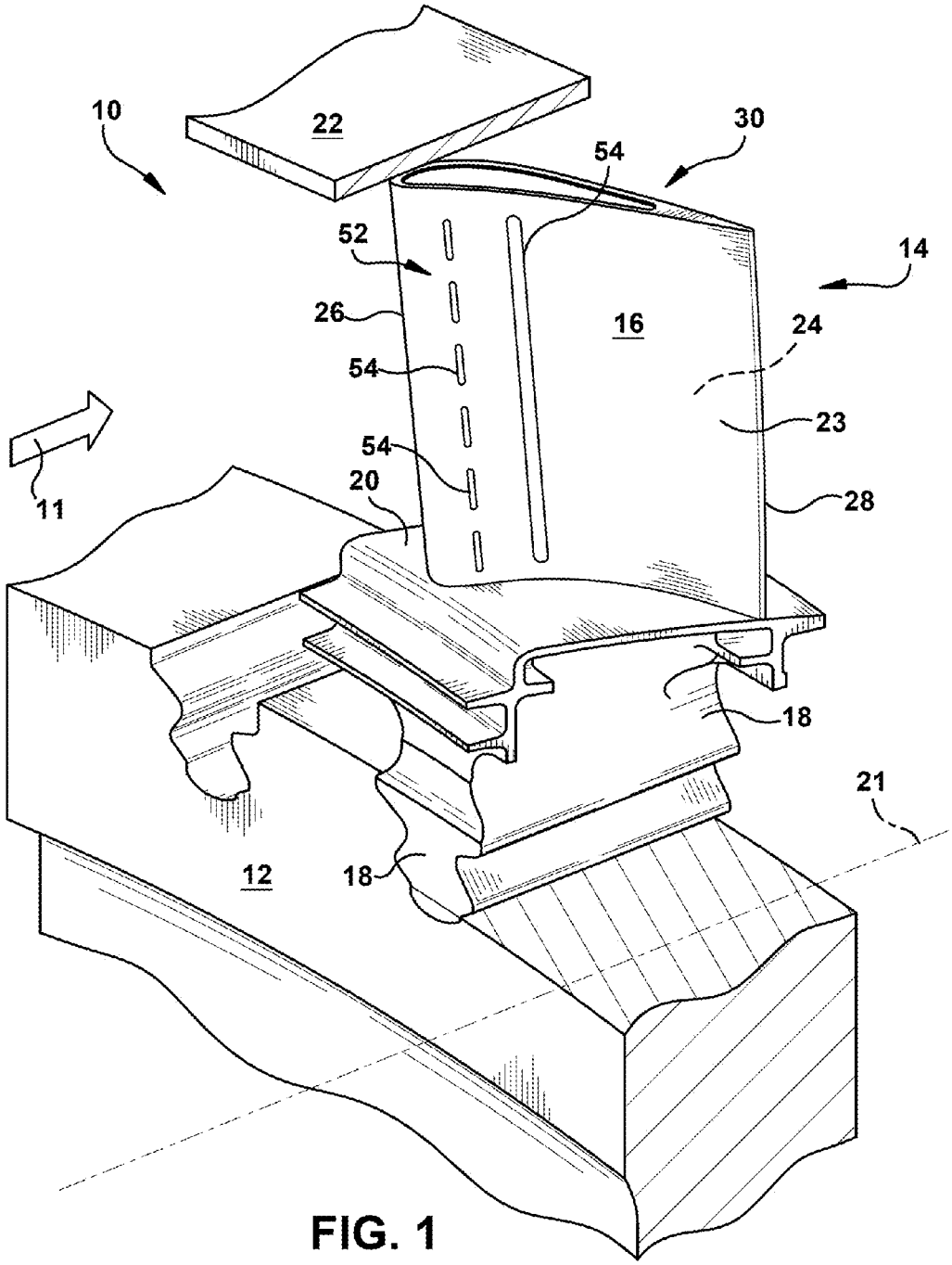
FIG. 1 is a partly sectional, isometric view of an exemplary gas turbine engine rotor blade mounted in a rotor disk within a surrounding shroud, with the blade having a metered cooling slot consistent with an exemplary embodiment of the present invention.

Referring now to the drawings, wherein identical numerals indicate the same elements throughout the figures, FIG. 1 depicts a turbine assembly 10 of a gas turbine engine. The turbine assembly 10 is mounted directly downstream from a combustor (not shown) for receiving hot combustion gases 11 therefrom. The turbine assembly 10 generally comprises a disk 12 having a plurality of rotor blades 14 securely attached thereto. Typically, the rotor blade 14 comprises a hollow airfoil 16 that extends radially from a root 18, which it generally is integral therewith. A platform 20 is disposed at the base of the airfoil 16 and generally is also integral therewith. The turbine assembly 10 is axisymmetrical about an axial centerline axis 21. An annular shroud 22 surrounds the blades 14 and is suitably joined to a stationary stator casing (not shown). The shroud 22 provides a relatively small clearance or gap between it and the rotor blades 14, which limits the leakage of combustion gases 11 over the blades 14 during operation.

The airfoil 16 preferably includes a generally concave pressure sidewall 23 and a circumferentially or laterally opposite, generally convex suction sidewall 24. Both the pressure sidewall 23 and the suction sidewall 24 extend axially between a leading edge 26 and a trailing edge 28. The pressure sidewall 23 and the suction sidewall 24 further extend in the radial direction between the radially inner root 18 at the platform 20 and a radially outer blade tip 30. Further, as discussed in more detail below, the pressure sidewall 23 and suction sidewall 24 are spaced apart in the circumferential direction over substantially the entire radial span of airfoil 16 to define at least one hollow internal flow chamber for channeling a supply of air through the airfoil 16 for the cooling thereof. The supply of air is typically bled from the compressor (not shown) in a conventional manner. Consistent with exemplary embodiments of the present invention, also illustrated are a plurality of metered cooling slots 52 that include an elongated slot 54 that extends radially along the surface of the airfoil as well as other components that will be discussed in detail below.

Note that the metered cooling slots 52 of the present invention are discussed in relation to their usage in turbine rotor blades. Rotor blades, as stated, are the rotating blades within the turbine section of the engine. This description is exemplary only, as the invention described herein is not limited to usage with only turbine rotor blades. As one of ordinary skill in the art will appreciate, the present invention also may be applied to turbine stator blades, which, generally, are the stationary blades within the turbine section of the engine that redirect and focus the flow of working fluid onto the rotor blades. Accordingly, reference herein to "turbine blades" or "blades", without further specificity, is meant to be inclusive of both turbine rotor blades and stator blades.

Figure 3:
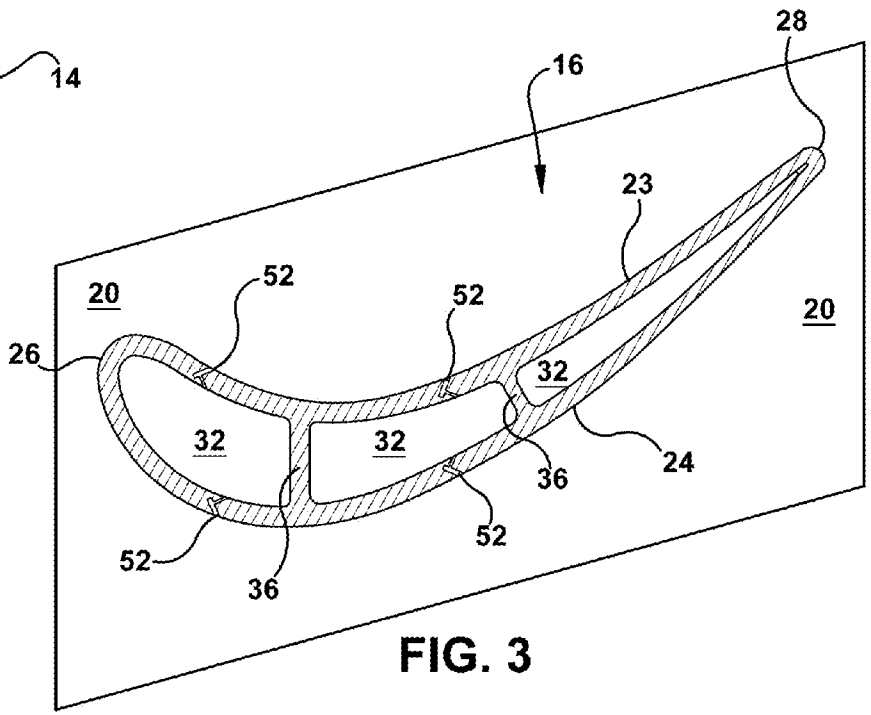
FIG. 3 is a top view of a rotor blade having a metered cooling slot consistent with an exemplary embodiment of the present invention.
Figure 2:
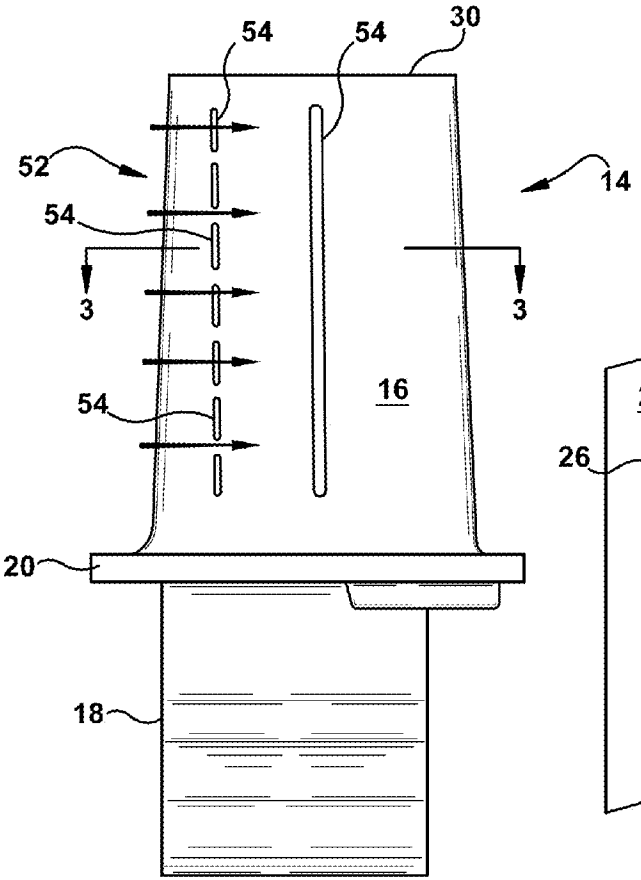
FIG. 2 is a side view of a rotor blade having a metered cooling slot consistent with an exemplary embodiment of the present invention.

Referring now to FIGS. 2 and 3, a turbine blade 14 is shown in side and top section view, respectively. As best shown in FIG. 3, the pressure sidewall 23 and the suction sidewall 24 have an outer surface and an inner surface. The inner surface defines a longitudinally extending internal chamber 32, which, as illustrated, may be divided into a plurality of adjacent longitudinally extending compartments. The structures separating the internal chamber 32 may be generally referred to as ribs 36. Typically, a passageway (not shown) within the root 18 communicates with the internal chamber 32 such that, during operation, the passageway within the root 18 is fed pressurized coolant fluid, usually compressed air, which is then passed to the internal chamber 32. As stated, this fluid may be compressor bleed air.

As illustrated in FIGS. 2 and 3, consistent with an exemplary embodiment of the present invention, the airfoil 16 includes a plurality of radial extending metered cooling slots 52. Depending on the application, the metered cooling slots 52 may be positioned in the suction sidewall 24, the pressure sidewall 23, or both the suction sidewall 24 and the pressure sidewall 23. In some embodiments, as illustrated, one of the metered cooling slots 52 may include a slot 54 that extends substantially the full radial length of the airfoil 16, although this is not a requirement. The length of the slot 54 may be tailored depending on the desired performance. For example, FIGS. 2 and 3 also show a plurality of metered cooling slots 52 that have slots 54 of a shorter length. The shorter slots 52, as illustrated, may be aligned in a radially extending column. Other configurations, of course, are possible. Preferably, metered cooling slots 52 are configured such that the direction of elongation of the slot 54 is approximately or roughly perpendicular to the flow of working fluid.

The number, positioning and orientation of the metered cooling slots 52 may be optimized for the particular geometry of the turbine blade or other component or part that requires film cooling. As illustrated in FIG. 3, metered cooling slots 52 may be located on either the pressure sidewall 23 or the suction sidewall 24. In addition, metered cooling slots 52 may be located in the middle portion of either the pressure sidewall 23 or the suction sidewall 24 or toward the leading edge 26 or the trailing edge 28 of each. Preferably, though, metered cooling slots 52 generally will be located in either the middle portion or toward the leading edge 26 of the airfoil sidewall 26, 28, as this positioning ensures that there will be adequate downstream airfoil surface area for the expelled cooling air to function properly. Further, metered cooling slots 52, in accordance with the present invention, may be used on other parts of the rotor blade 14, such as, for example, the platform 20. Likewise, the metered cooling slots 52 according to the present invention may be used on the airfoil sidewalls or platforms of turbine stator blades (not shown).

Figure 4:
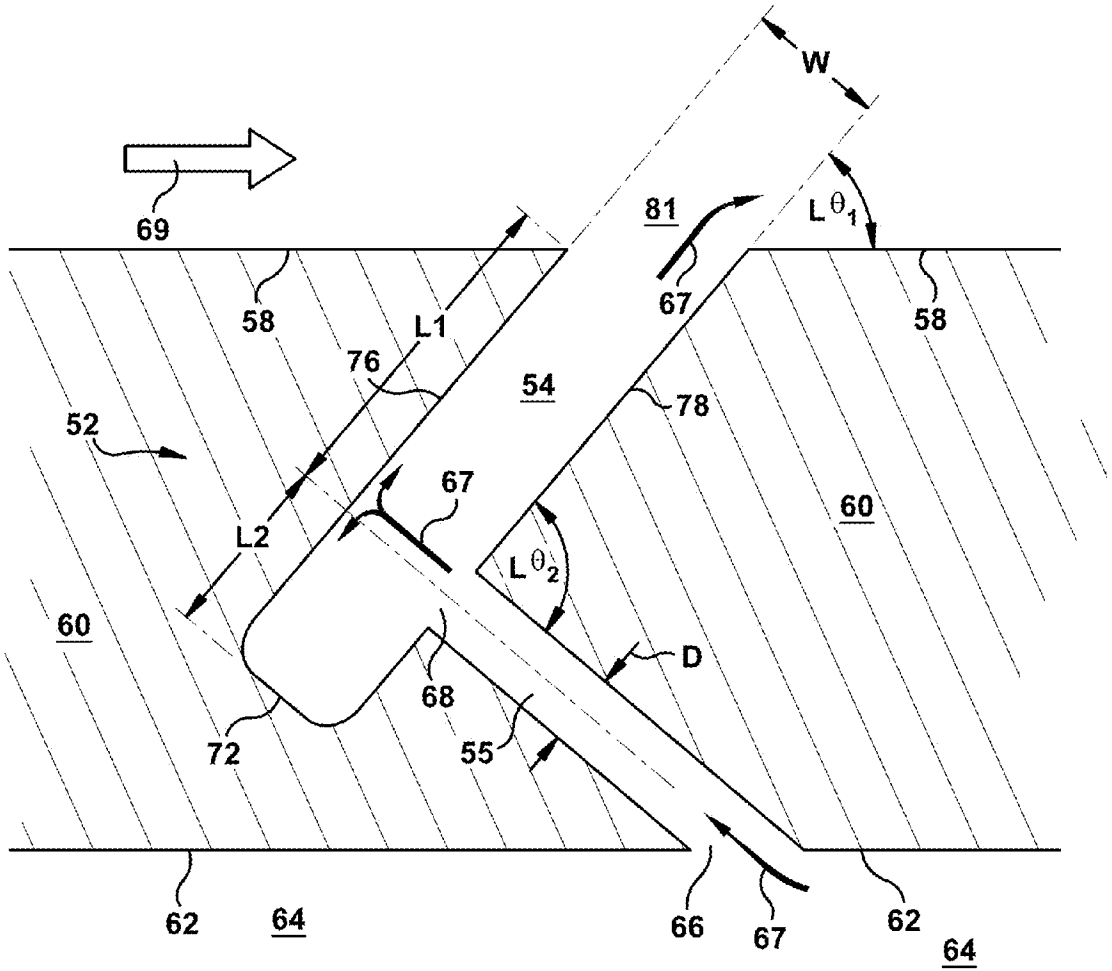
FIG. 4 is a sectional view of a turbine sidewall having a metered cooling slot consistent with an exemplary embodiment of the present invention.

Consistent with an exemplary embodiment of the present invention, FIG. 4 illustrates a section view of a metered cooling slot 52. The metered cooling slot 52 generally includes a slot 54 and one or more metering apertures 55. Cooling slots with metering passages of the general arrangement shown in FIG. 4 have been proposed. However, as one of ordinary skill in the art will appreciate, the general configuration shown in FIG. 4 of a metered cooling slot has multiple parameters. The interplay between these several parameters defines both the shape and geometry of this cooling feature and, thereby, significantly impacts its performance during operation.

The several parameters, each of which will be discussed in more detail below, include the following: 1) D represents the diameter of a metering aperture; 2) P represents the pitch, which is the distance between the center lines of neighboring metering apertures; 3) L1 represents the slot length, which is the distance from the center line of a metering aperture to the slot outlet; 4) L2 represents the base length, which is the distance from the end of the slot to the center line of the metering aperture; 5) W represents the width of the slot; 6) $\angle\theta_1$ represents the slot angle, which is the angle the slot makes with the outer surface; and 7) $\angle\theta_2$ represents the metering aperture angle, which is the angle the metering aperture makes with the cooling slot. As stated, each one of these parameters may significantly affect the cooling characteristics of a metered cooling slot. As one of ordinary skill in the art will appreciate, discovering the combinations that deliver enhanced performance out of the multitude of possibilities requires technical expertise, intuition, and laboratory testing. Note that as used herein D may represent the diameter of a metering aperture that is circular in cross-sectional shape. However, as one of ordinary skill in the art will appreciate, when the metering aperture is of a different cross-sectional shape, D may represent the hydraulic diameter of the metering aperture, which may be determined as follows: D=4*(Cross-sectional area of the metering aperture)/(perimeter of the metering aperture).

As stated, the metered cooling slot 52 of FIG. 4 is comprised of a slot 54 and one or more metering apertures 55. Cooling slots 54 generally comprise elongated hollow slots that extend at an angle into an outer surface 58 of an airfoil sidewall 60. (As discussed above, the outer surface 58 may comprise the pressure sidewall 23 or suction sidewall 24 of the airfoil—sometimes referred to as the pressure side or suction side—or the platform 20 or other surfaces in the hot-gas path of the turbine engine or other industrial machinery.) Metering apertures 55 generally comprise narrow hollow circular passages of diameter D that extend from an inlet 66 defined in an inner surface 62 of an internal cooling chamber 64 to the slot 54. The slot 54 and the metering aperture 55 intersect to form $\angle\theta_2$. Preferably, $\angle\theta_2$ is a relatively steep angle such that the metering apertures 55 are oriented to direct the flow of coolant fluid (the flow of which is indicated in FIG. 4 with arrows 67) from their outlets 68 at a sharp angle against the opposite surface of the slot 54 to produce impingement cooling at the slot surface and to spread the coolant fluid within the slot 54.

The slot 54 and the outer surface 58 of the sidewall 60 intersect to form $\angle\theta_1$. Throughout this specification and in the claims, the downstream direction is considered to be the direction of the flow of hot gases or working fluid over the external surface of the airfoil. This direction is represented in FIG. 4 by arrow 69. In general, the slot 54 preferably is oriented such that the flow of coolant fluid exiting therefrom has a major component of velocity in the downstream direction. This generally requires that the angled slot 54 be "aimed" downstream. Further, it requires that the slot 54 intersect the external surface 57 of the sidewall such that $\angle\theta_1$ comprises a shallow angle.

The slot 54 further includes a base 72 and a pair of closely spaced apart, oppositely facing, longitudinally extending surfaces 76, 78 that intersect the outer surface 58 of the sidewall 60 to form the slot outlet 81. The metering apertures 55 intersect the surface 78 of the slot 54 to form metering aperture outlet 68. As indicated, the metering apertures 55 intersect surface 78 at a distance, L1, from the slot outlet 81. L1, as stated, represents slot length, i.e., the distance from the center line of the metering aperture 60 to the slot outlet 81. The metering apertures 55 also intersect surface 78 at a distance, L2, from the base 72. L2, as stated, represents base length, i.e., the distance from the base 72 to the center line of the metering aperture 60.

The surfaces 76, 78 are approximately parallel from the slot base 72 to the outer surface 58. The slot width, W, represents the approximate distance between surfaces 76, 78.

Figure 5:
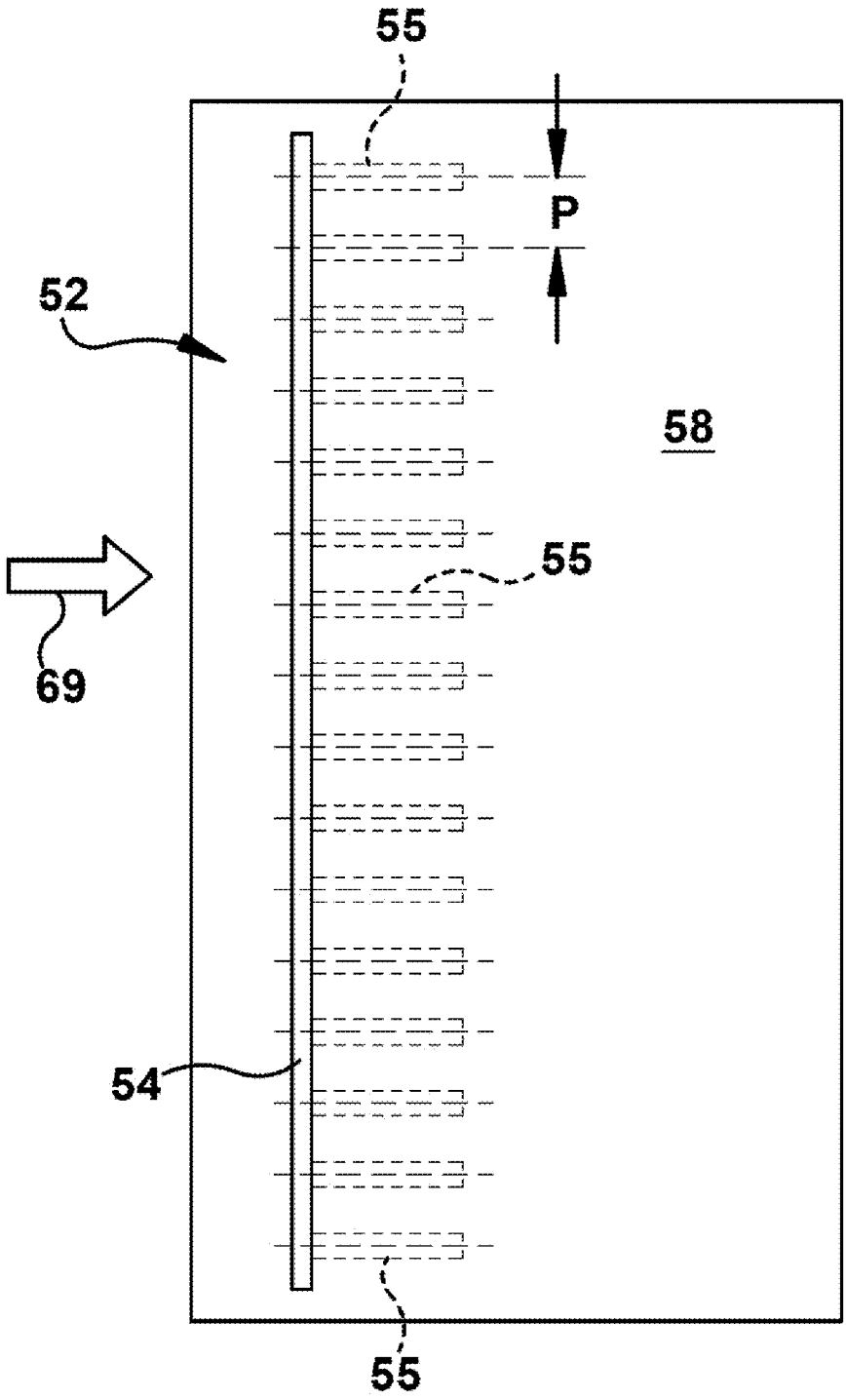
FIG. 5 is a side view of a turbine airfoil having a metered cooling slot consistent with an exemplary embodiment of the present invention.

As illustrated in FIG. 5, the metering apertures 55 may be radially spaced apart along the radial length of the cooling slot 54 and, thereby, provide a metered flow of coolant from the internal cooling chamber 64 along the length of the slot 54. Preferably, the metering apertures 55 are spaced at substantially regular distances along the cooling slot 54. When evenly spaced, a metering aperture pitch value or P may be determined. P, as used herein, represents the approximate distance between neighboring metering apertures 55. When the metering apertures 55 of a particular slot 54 are regularly spaced, a value for P may represent the approximate distance between each pair of neighboring apertures. Specifically, P indicates the approximate distance between a midpoint line through a first metering aperture 55 and a midpoint line through a neighboring second metering aperture 55.

Consistent with the above description and definitions, it has been discovered that metered cooling slots having configurations consistent with the following findings offer enhanced cooling characteristics and represent exemplary embodiments of the present application. Note that generally the performance of a metered cooling slot remains consistent as the several parameters are proportionally increased or decreased in size. Thus, as one of ordinary skill in the art will appreciate, the parameters for effective configurations may be communicated in ratios.

Figure 6:
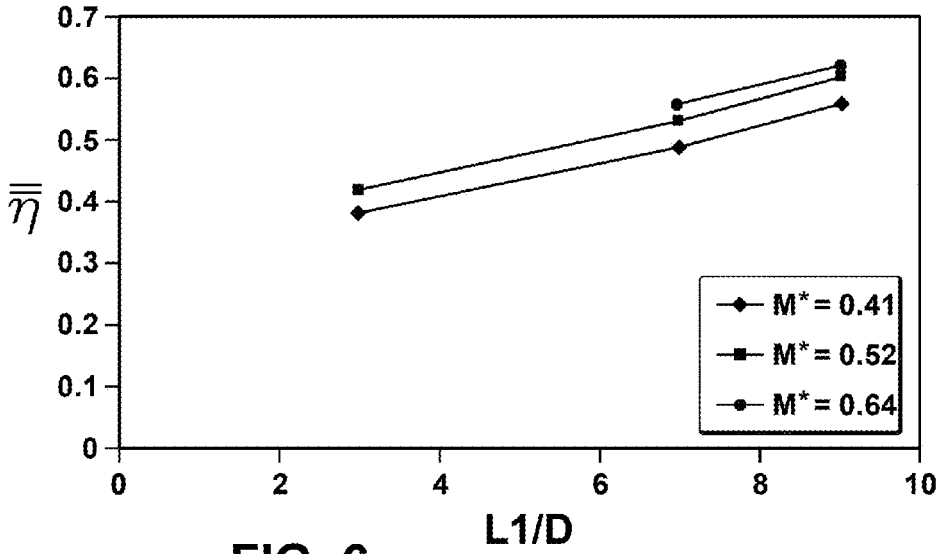
FIG. 6 illustrates a graph of test results relating to preferred embodiments of the present application.
Figure 7:
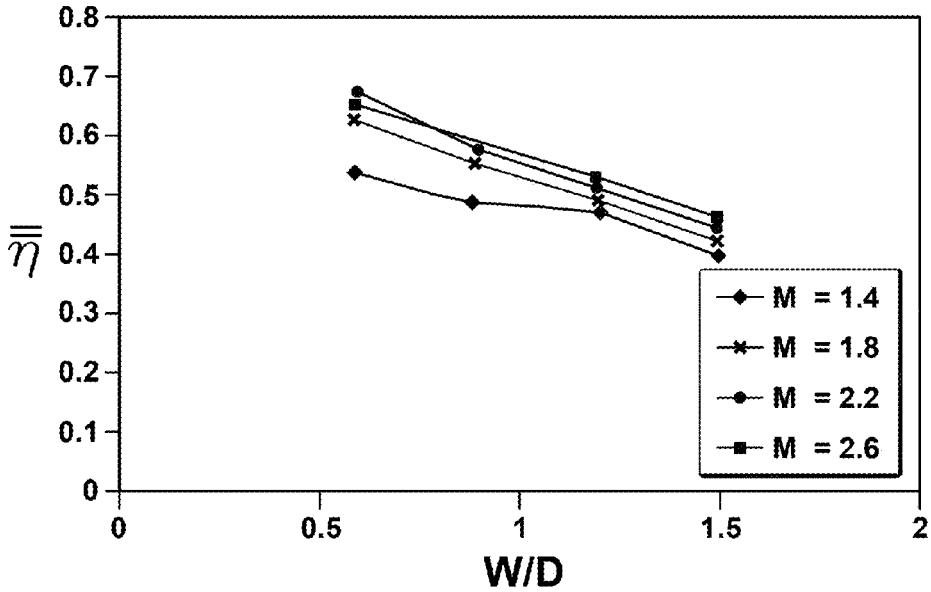
FIG. 7 illustrates a graph of test results relating to preferred embodiments of the present application.
Figure 8:
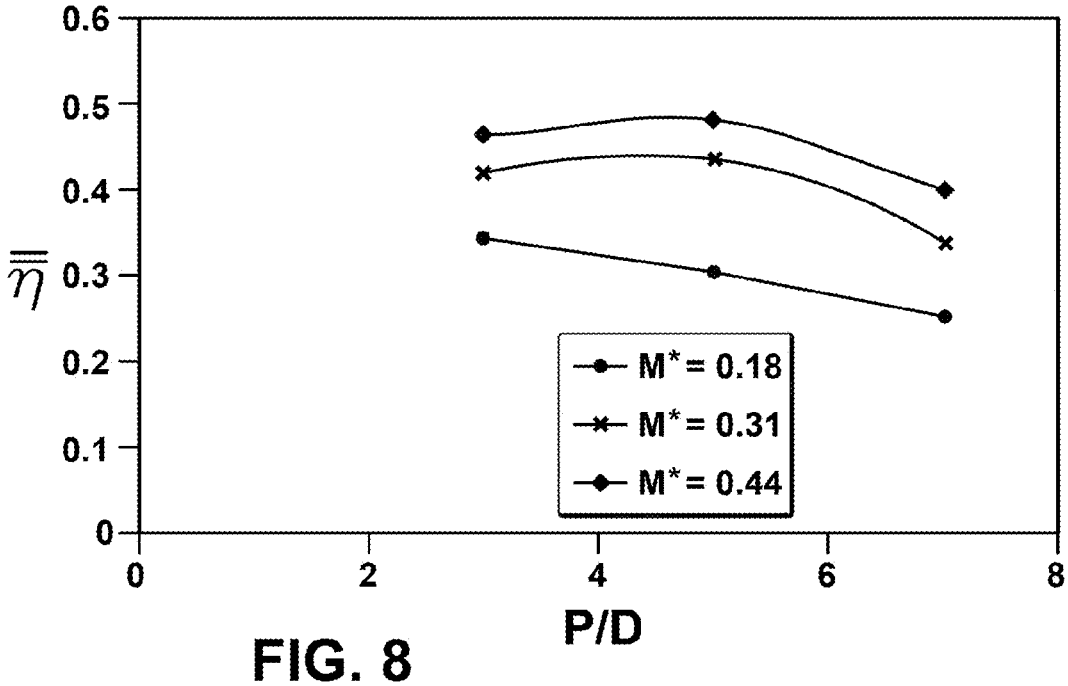
FIG. 8 illustrates a graph of test results relating to preferred embodiments of the present application.

FIGS. 6, 7 and 8 generally show test results or plots concerning the cooling properties of varying configurations of metered cooling slots. In all of the plots, the vertical axis is a measure of adiabatic effectiveness, or "η", which generally is a conventional measure of film cooling effectiveness. Adiabatic effectiveness is the ratio of A/B where A is the temperature differential between the flow of hot gases through the turbine (i.e., the main flow) and the coolant film layer that forms downstream of the cooling slot and B is the temperature differential that exists between the main flow and the coolant flow before the coolant flow is released in the main flow. As one of ordinary skill in the art will appreciate, an adiabatic effectiveness value approaching 1.0 corresponds to ideal or perfect film cooling, as the film that forms substantially remains at the temperature of the coolant flow. This, of course, provides a maximum level of cooling to the airfoil or hot gas path component. Whereas, an adiabatic effectiveness value approaching 0.0 corresponds to a substantially complete film cooling failure, as the temperature of the film substantially is equal to the temperature of the main flow. This, of course, provides a minimum level of cooling to the airfoil or hot-path component. In addition, for completeness, several trials were performed at varying blowing ratios, or "M", to ensure the configurations could perform across a spectrum of values for this parameter. As one of ordinary skill in the art will appreciate, the "blowing ratio" is the ratio of C/D where C is the density multiplied by the velocity of the coolant flow and D is the density multiplied by the velocity of the main flow. The blowing ratio has been calculated at the exit of the slot 54.

In FIG. 6, the horizontal axis is a measure of L1/D. As described already, L1 represents the distance from the center line of a metering aperture to the slot outlet, and D represents the diameter of the metering aperture. As illustrated in FIG. 6, it was discovered that once the L1/D ratio is greater than about 7, the adiabatic cooling effectiveness is relatively high and, from there, increases at a slightly higher rate. Embodiments according to the current application, thus, will preferably have a L1/D ratio of greater than about 7, and, more preferably, will have a L1/D ratio of greater than about 8. In other embodiments, configurations according to the current application will have a L1/D ratio of between 8-10.

In FIG. 7, the horizontal axis is a measure of W/D. As described already, W represents the width of the slot, while D represents the diameter of the metering aperture. As illustrated in FIG. 7, it was discovered that when the W/D ratio is less than about 1.0, the adiabatic cooling effectiveness remains relatively high and, in fact, increases at a slightly higher rate at decreasing values of the W/D ratio. Embodiments according to the current application, thus, will preferably have a W/D ratio of less than about 1.0, and, more preferably, will have a W/D ratio of less than about 0.75. In other embodiments, configuration according to the current application, will have a W/D ratio of between about 0.025-0.75.

In FIG. 8, the horizontal axis is a measure of P/D. As described already, P, or pitch, represents the distance between the center lines of neighboring metering apertures (as shown in FIG. 5), while D represents the diameter of the metering aperture. As illustrated in FIG. 8, it was discovered that when the P/D ratio is between about 4 and 6, the adiabatic cooling effectiveness peaks and remains relatively high on either side of the peak. P/D values that fall out of this range generally coincide with a significant reduction in adiabatic effectiveness. Embodiments according to the current application, thus, will preferably have a P/D ratio of between about 4 and 6, and, more preferably, will have a P/D ratio of between about 4.5 and 5.5. In other embodiments, configurations according to the current application will have a P/D ratio of approximately 5.

The values and ranges noted about may be used together or separately. In addition, it was determined that $\angle\theta_1$, which represents the angle the slot makes with the outer surface, may produce effective results when it is between about 10° and 50°, and, more preferably, when $\angle\theta_1$ is about 30°. Note that the above configurations may be used with a $\angle\theta_1$ that is outside of these ranges and still produce effective results. In addition, it was determined that $\angle\theta_2$, which represents the angle the metering aperture makes with the cooling slot, may produce effective results when it is between about 50° and 130°, and, more preferably, when it is about 90°. Note that the above configurations may be used with a $\angle\theta_2$ that is outside of these ranges and still produce effective results. As described, L2 represents the distance from the end of the slot or base to the center line of the metering aperture. It has been discovered that performance of the metered cooling slot is not heavily dependent on the distance of L2. Accordingly, expressed in relation to D, the diameter of the metering aperture, in some embodiments, the ratio L2/D preferably will have a value between 0.25 and 1.25, and, more preferably, will have a value between 0.75 and 1.0.

From the above description of preferred embodiments of the invention, those skilled in the art will perceive improvements, changes and modifications. Such improvements, changes and modifications within the skill of the art are intended to be covered by the appended claims. Further, it should be apparent that the foregoing relates only to the described embodiments of the present application and that numerous changes and modifications may be made herein without departing from the spirit and scope of the application as defined by the following claims and the equivalents thereof.

We claim:

1. A metered cooling slot disposed in a wall comprising an outer surface that is exposed to a hot gas stream flowing in a downstream direction and an inner surface that defines a portion of an internal coolant chamber through which a coolant passes, the metered cooling slot comprising:

a slot formed within the outer surface elongated in a first direction, the slot comprising a pair of spaced apart, opposing, slot surfaces and a base, the slot surfaces intersecting the outer surface at a shallow angle to form a slot outlet opposite the base; and two or more metering apertures formed within the wall, each metering aperture intersecting the inner surface of the wall to form a metering aperture inlet and intersecting one of the pair of slot surfaces to form a metering aperture outlet, the metering aperture being oriented to direct the coolant against the opposite slot surface at a steep angle;

wherein:

D represents the approximate diameter of at least two of the metering apertures;

P represents the approximate distance between the center lines of at least two neighboring metering apertures; and P/D comprises a value within the range of about 4 to 6.

2. The metered cooling slot according to claim 1, wherein:

the first direction is substantially perpendicular to the downstream direction; and the metering apertures are sized to provide a desired rate of flow of the coolant into the slot.

3. The metered cooling slot according to claim 1, wherein P/D comprises a value within the range of about 4.5 to 5.5.

4. The metered cooling slot according to claim 1, wherein P/D comprises a value of about 5.

5. The metered cooling slot according to claim 1, wherein:

L1 comprises the distance from the center line of a metering aperture to the slot outlet; and L1/D comprises a value of greater than about 7.

6. The metered cooling slot according to claim 5, wherein L1/D comprises a value of greater than about 8.

7. The metered cooling slot according to claim 5, wherein L1/D comprises a value within the range of about 8 to 10.

8. The metered cooling slot according to claim 1, wherein:

W comprises the width of the slot; and

W/D comprises a value of less than about 1.

9. The metered cooling slot according to claim 8, wherein W/D comprises a value of less than about 0.75.

10. The metered cooling slot according to claim 8, wherein W/D comprises a value within the range of about 0.25 to 0.75.

11. The metered cooling slot according to claim 1, wherein:

$\angle\theta_1$ comprises the angle the slot makes with the outer surface; and $\angle\theta_1$ comprises a value within the range of about 10° and 50°.

12. The metered cooling slot according to claim 11, wherein $\angle\theta_1$ comprises a value of about 30°.

13. The metered cooling slot according to claim 1, wherein:

$\angle\theta_2$ comprises the angle the metering aperture makes with the cooling slot; and $\angle\theta_2$ comprises a value within the range of about 50° to 130°.

14. The metered cooling slot according to claim 13, wherein $\angle\theta_2$ comprises a value of about 90°.

15. The metered cooling slot according to claim 1, wherein:

L2 comprises the distance from the base of the slot to the center line of the metering aperture; and L2/D comprises a value within the range of about 0.25 and 1.25.

16. The metered cooling slot according to claim 15, wherein L2/D comprises a value within the range of about 0.75 and 1.0.

17. The metered cooling slot according to claim 1, wherein:

the wall is a wall formed in one of a turbine rotor blade and a turbine stator blade; and the wall comprises one of a pressure sidewall of the airfoil, a suction sidewall of the airfoil, or a platform.

18. The metered cooling slot according to claim 1, wherein the slot is oriented such that coolant is expelled through the slot outlet with a component of velocity in the downstream direction.

19. A metered cooling slot disposed in a wall comprising an outer surface that is exposed to a hot gas stream flowing in a downstream direction and an inner surface that defines a portion of an internal coolant chamber through which a coolant passes, the metered cooling slot comprising:

a slot formed within the outer surface elongated in a first direction, the slot comprising a pair of spaced apart, opposing, slot surfaces and a base, the slot surfaces intersecting the outer surface at a shallow angle to form a slot outlet opposite the base; and two or more metering apertures formed within the wall, each metering aperture intersecting the inner surface of the wall to form a metering aperture inlet and intersecting one of the pair of slot surfaces to form a metering aperture outlet, the metering aperture being oriented to direct the coolant against the opposite slot surface at a steep angle;

wherein:

D represents the approximate diameter of at least two of the metering apertures;

P represents the approximate distance between the center lines of at least two neighboring metering apertures;

L1 comprises the distance from the center line of a metering aperture to the slot outlet;

W comprises the width of the slot;

$\angle\theta_1$ comprises the angle the slot makes with the outer surface;

$\angle\theta_2$ comprises the angle the metering aperture makes with the cooling slot;

L2 comprises the distance from the base of the slot to the center line of the metering aperture;

P/D comprises a value within the range of about 4.5 to 5.5;

L1/D comprises a value of greater than about 8;

W/D comprises a value of less than about 0.75;

$\angle\theta_1$ comprises a value of about 30°;

$\angle\theta_2$ comprises a value of about 90° ; and

L2/D comprises a value within the range of about 0.75 and 1.0.

20. The metered cooling slot according to claim 19, wherein:

the wall is a wall formed in one of a turbine rotor blade and a turbine stator blade; and the wall comprises one of a pressure sidewall of the airfoil, a suction sidewall of the airfoil, or a platform.

* * * * *